US007240621B2

(12) United States Patent
Chepurny et al.

(10) Patent No.: US 7,240,621 B2
(45) Date of Patent: Jul. 10, 2007

(54) PERSONAL LIFT DEVICE

(75) Inventors: Mark Chepurny, Newmarket (CA); Gordon J. Molnar, Toronto (CA); Michael F. Wilson, Toronto (CA)

(73) Assignee: Prism Medical Ltd, Mississauga, Ontario (CA)

( * ) Notice: Subject to any disclaimer, the term of this patent is extended or adjusted under 35 U.S.C. 154(b) by 0 days.

(21) Appl. No.: 10/502,815

(22) PCT Filed: Jan. 27, 2003

(86) PCT No.: PCT/CA03/00094

§ 371 (c)(1),
(2), (4) Date: Feb. 8, 2005

(87) PCT Pub. No.: WO03/064312

PCT Pub. Date: Aug. 7, 2003

(65) Prior Publication Data

US 2005/0115914 A1 Jun. 2, 2005

(30) Foreign Application Priority Data

Jan. 28, 2002 (CA) ..... 2369668

(51) Int. Cl.
*B61B 7/00* (2006.01)

(52) U.S. Cl. ..... 104/173.1

(58) Field of Classification Search ..... 104/173.1, 104/173.2, 178, 127, 128; 5/81.1, 89.1, 83.1, 5/87.1; 212/326
See application file for complete search history.

(56) References Cited

U.S. PATENT DOCUMENTS 1,536,766 A * 5/1925 Cammann ..... 212/345
2,272,778 A * 2/1942 Reuter ..... 5/85.1
3,123,224 A * 3/1964 Kral ..... 212/330
3,351,959 A * 11/1967 Turpin ..... 5/83.1
3,569,809 A 3/1971 Comer ..... 318/338
3,629,880 A 12/1971 Van Rhyn ..... 5/86
4,117,561 A 10/1978 Zamotin ..... 5/83
4,138,077 A * 2/1979 Okumura ..... 244/137.2
4,202,064 A 5/1980 Joergensen ..... 5/83
4,425,674 A 1/1984 Werner ..... 5/68

(Continued)

FOREIGN PATENT DOCUMENTS

CA 2217421 4/1999

(Continued)

*Primary Examiner*—S. Joseph Morano
*Assistant Examiner*—Robert J. McCarry, Jr.
(74) *Attorney, Agent, or Firm*—Vidas, Arrett & Steinkraus PA

(57) ABSTRACT

A personal lift device is disclosed having a motor having an output shaft. A gearing system is operatively connected to the output shaft for increasing torque. A strap for suspending a weight is wound onto a spool and rotating the spool extends and retracts the strap. A drive connection is made between the gearing system and the spool to permit said motor to drive said spool. A brake is associated with said spool to prevent unwanted extension of said strap from said spool, when a weight is suspended by said strap. In a preferred embodiment a clutch is provided between the brake and the drive train, and the greater the weight supported by the spool the greater the braking force. An emergency lift and lower device is also provided in the event of a failure of the motor.

21 Claims, 6 Drawing Sheets

U.S. PATENT DOCUMENTS

| | | | | | |
|---|---|---|---|---|---|
| 4,633,538 | A | | 1/1987 | James | 5/86 |
| 4,944,056 | A | | 7/1990 | Schroeder et al. | 5/81 |
| 5,038,425 | A | | 8/1991 | Merry | 5/83 |
| 5,072,840 | A | * | 12/1991 | Asakawa et al. | 212/312 |
| 5,165,123 | A | | 11/1992 | Colpron | 5/83.1 |
| 5,327,592 | A | | 7/1994 | Stump | 5/81.1 |
| 5,553,335 | A | | 9/1996 | Lahtinen | 5/81.1 |
| 5,588,932 | A | | 12/1996 | Lindblad | 475/341 |
| 5,694,654 | A | * | 12/1997 | Roy | 5/83.1 |
| 5,809,591 | A | | 9/1998 | Capaldi et al. | 5/83.1 |

FOREIGN PATENT DOCUMENTS

| | | |
|---|---|---|
| DE | 3432043 | 3/1986 |
| DE | 3442138 | 5/1986 |
| DE | 3516714 | 11/1986 |
| GB | 2201449 | 9/1988 |
| SE | 7812239 | 5/1980 |
| WO | 0026133 | 5/2000 |

* cited by examiner

PERSONAL LIFT DEVICE

This application is a claims priority to International Publication Number WO 03/064312 A2, which has an international filing date of Jan. 27, 2003; and which claims priority to Canadian Patent Application No. 2,369,668 filed Jan. 28, 2002, and is related to Canadian Application No. 2,417,506; the entire contents of all of which are incorporated herein by reference.

FIELD OF THE INVENTION

This invention relates generally to the field of mobility devices, and more particularly to personal lift devices of the type that may be used to raise or lower a physically disabled person for the purpose of moving them. Most particularly, this invention relates to a form of personal lift device that can be activated to raise or lower a patient or physically disabled person.

BACKGROUND OF THE INVENTION

Personal lift or patient lift devices have been known and used in the past for the purpose of assisting with the mobility of otherwise immobilized patients. An attendant may help physically disabled patients who may have suffered a traumatic injury, stroke or one form of illness or another, and who are unable to move about. However, often such patients may be too heavy to lift or the attendant may not have enough strength to help the patient move. This can be especially true for disabled patients who have reduced mobility but otherwise normal bodily functions. Getting up, going to the bathroom and having a bath, for example, can be difficult for such patients.

Personal lift devices that have been used in the past typically include a strap or chain hanging down from a motor assembly, which in turn may be suspended from a movable stand or from a rail carriage riding along an overhead track. An overhead track can be organized to extend from over a bed and into, for example, an adjoining bathroom area, to permit the patient to be raised, suspended, and then moved along the track to a position where they can be lowered into the bathtub for the purposes of a bath, or onto a toilet.

Typically such patient lift devices are provided with an electronic lift motor and with an inefficient gear train system. The latter is believed desired, because, in the event of a power failure, the inefficiency of the gear train means there is no quick release or lowering of a patient in a downward direction. In other words, the motor and power train are self-braking. While providing such gearing inefficiencies does act as a safety brake, it also increases the cost, size, and weight of the lift apparatus, since a larger electric motor is required to both lift and lower against the gear train. As well, in the event of a malfunction due to electrical failure of the motor, the patient can be stuck suspended in mid air without any practical way of being released and lowered. Therefore, what is desired is a lighter, simpler, and more efficient device, which can be readily utilized for patient lifting and which preferably includes a safety release to prevent patients from being stranded in a suspended position.

SUMMARY OF THE INVENTION

According to the present invention a more efficient drive train can be used to reduce the work required to lift and lower patients. A more efficient drive train will result in either a smaller motor being required, or more lifting power being available for a motor of the same size. Quite simply the present invention comprehends having more of the energy of the electrical motor go into the lifting and lowering rather than simply being used to overcome the friction inherent in an inefficient gear train.

Another aspect is that the present invention comprehends using a brake associated with the power train to ensure that the patient is not unexpectedly lowered in the event of a power outage or motor failure. In one preferred form of the invention the brake force is related to the amount of weight suspended from the lifting device, in such a way that the greater the weight the greater the braking force.

Another aspect of the present invention is to provide a one-way clutch in the drive train to permit the drive train to turn freely as the motor is being used to raise the patient, which in turn lowers the work done by the motor in overcoming the friction during lifting. Most preferably the one way clutch mechanism is installed in at least a portion of the drive train to, for example, isolate the brake from the lifting cycle to reduce the work of lifting.

According to a further aspect of the invention, a manual emergency lowering device is provided which is both effective in terms of overcoming the brake, and which is readily accessible when needed and conveniently stored out of the way when not. In particular the present invention provides an emergency lower device that may be easily used by an attendant standing on the ground, even though the lift device may be located at or near the ceiling and otherwise out of reach.

The invention also comprehends a device in which non-emergency lowering, as well as lifting, are accomplished in the ordinary course through the manual effort of an attendant standing on the ground. In this device neither a motor nor a separate manual emergency lowering element would be required.

Therefore there is provided according to one aspect of the present invention a personal lift device comprising:

- a motor having an output shaft;
- a gearing system operatively connected to said output shaft for increasing torque;
- a strap for suspending a weight;
- a spool for suspending said strap and for extending and retracting said strap;
- a drive connection between said gearing system and said spool to permit said motor to drive said spool;
- a brake, associated with said spool to prevent unwanted extension of said strap from said spool, when a force is applied to said strap; wherein the gearing system is efficient enough to permit the spool to back drive, in the absence of a brake.

There is further provided, according to a second aspect of the present invention, a braking system for a personal lift device of the type where a weight is suspended by a strap and the strap may be extended or retracted from a spool, the braking system comprising:

- an operative connection between said brake and said spool;
- a clutch to permit said spool to turn without overcoming the brake when said weight is being raised by said strap;
- a frictional slip interface which slips when said weight is being lowered;
- wherein a braking force generated at said frictional slip interface is correlated to said weight, to generate a larger braking force under greater weights.

According to yet a further aspect of the present invention there is provided an emergency lift and lower assembly for a personal lift device comprising:

a cover releasably attached to said device, an elongate manually actuable element stored in said cover, and a drive train take off point associated with said cover, wherein, upon said cover being detached from said device, said element engages said take off point to permit movement of said element to raise or lower a weight suspended by said device.

According to yet a further aspect of the present invention there is provided an emergency lift and lower assembly for a personal lift device comprising:

a cover for protecting a drive train of said personal lift device;

a take off means extending from said cover and accessible from outside of said cover, said take off means operably connected to a drive train of said personal lift device; and a manually actuable element, releasably connected to said take off means, to remotely drive said take off means when said element is connected and to permit said element to be stored out of the way when said element is disconnected.

BRIEF DESCRIPTION OF THE DRAWINGS

Reference will now be made, by way of example only, to preferred embodiments of the present invention as depicted in the following drawings.

DETAILED DESCRIPTION OF THE PREFERRED EMBODIMENTS

Figure 1:
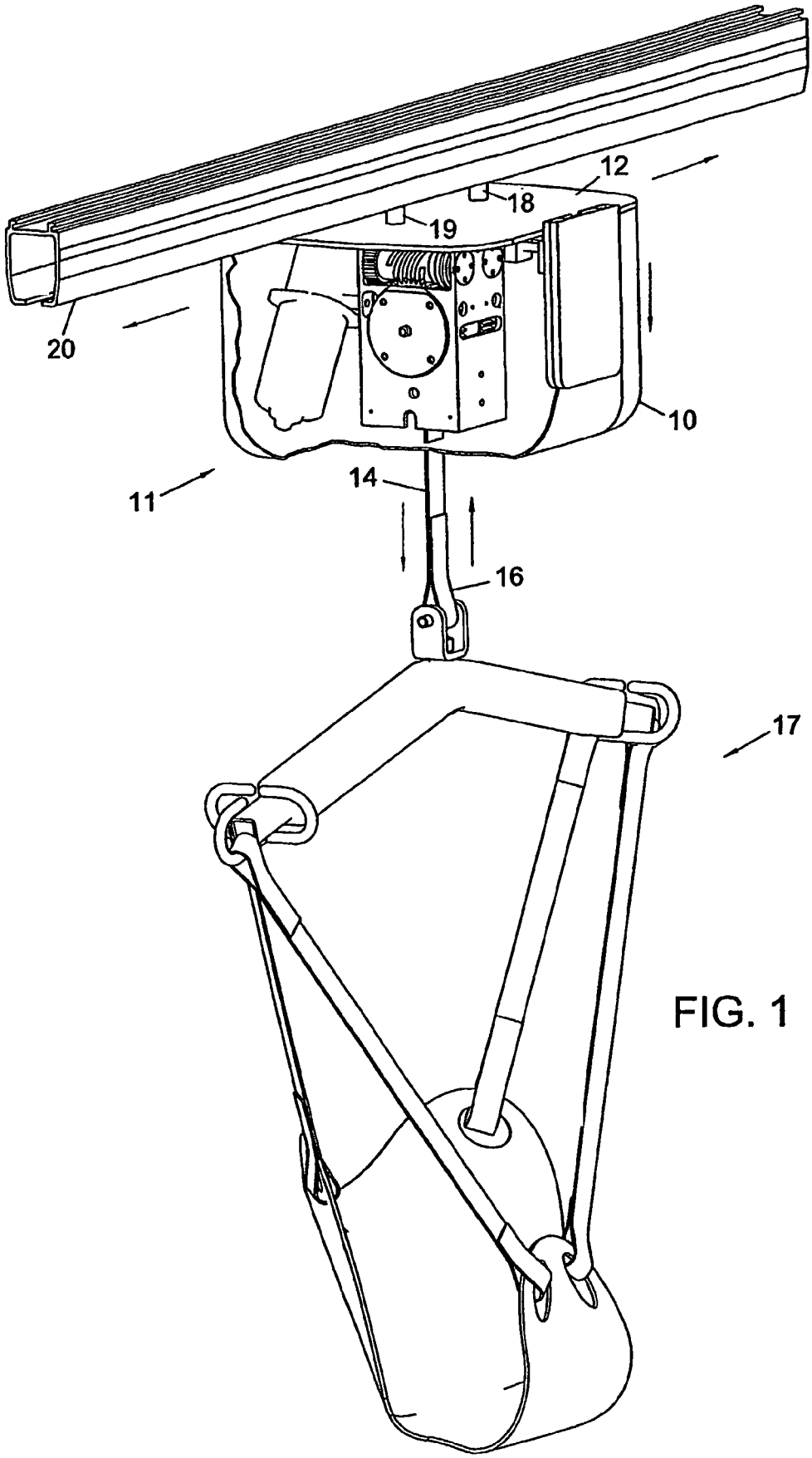
FIG. 1 is a perspective view of the present invention, showing the general arrangement of the elements but with an outer housing partially removed for ease of illustration.

FIG. 1 shows the main elements of the present invention. In FIG. 1 there is shown a housing 10 for a personal lift device 11. The housing 10 is attached to a base plate 12. The housing 10 covers the motor and drive train (described below) of the present invention and protects the same from dirt, dust, contaminants and the like. For ease of illustration, the housing 10 is shown partially removed, but it will be understood that in the preferred form the housing 10 fully surrounds and encloses the base plate 12, as well as the inner workings of the personal lift device 11.

Shown extending from the housing 10 is a lifting and lowering strap 14 with a looped end 16. The lifting and lowering strap 14 may be attached to a patient sling or other lift device 17, and by means of operation described below, the strap 14 is raised and lowered for the purpose of lifting the patient for facilitating movement of the patient carried in the lift device 17. Also shown are upper attachment elements 18, 19, that are used to attach the unit to a stand or overhead track 20 by means of a carriage (not shown) or the like. Although shown as a track 20, the present invention may also be used with a moveable stand or tripod, such as will be known in the art.

Figure 2B:
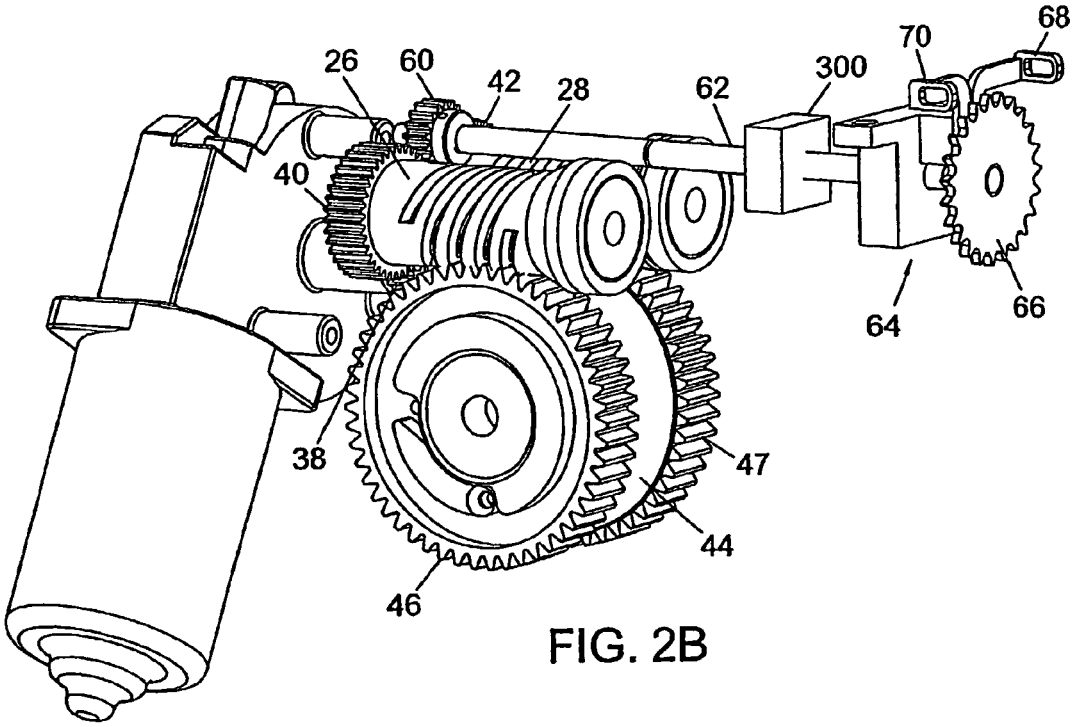
FIG. 2*b* is the same view as 2*a*, but with some of the supporting elements removed for illustrating the elements in the drive train.
Figure 2A:
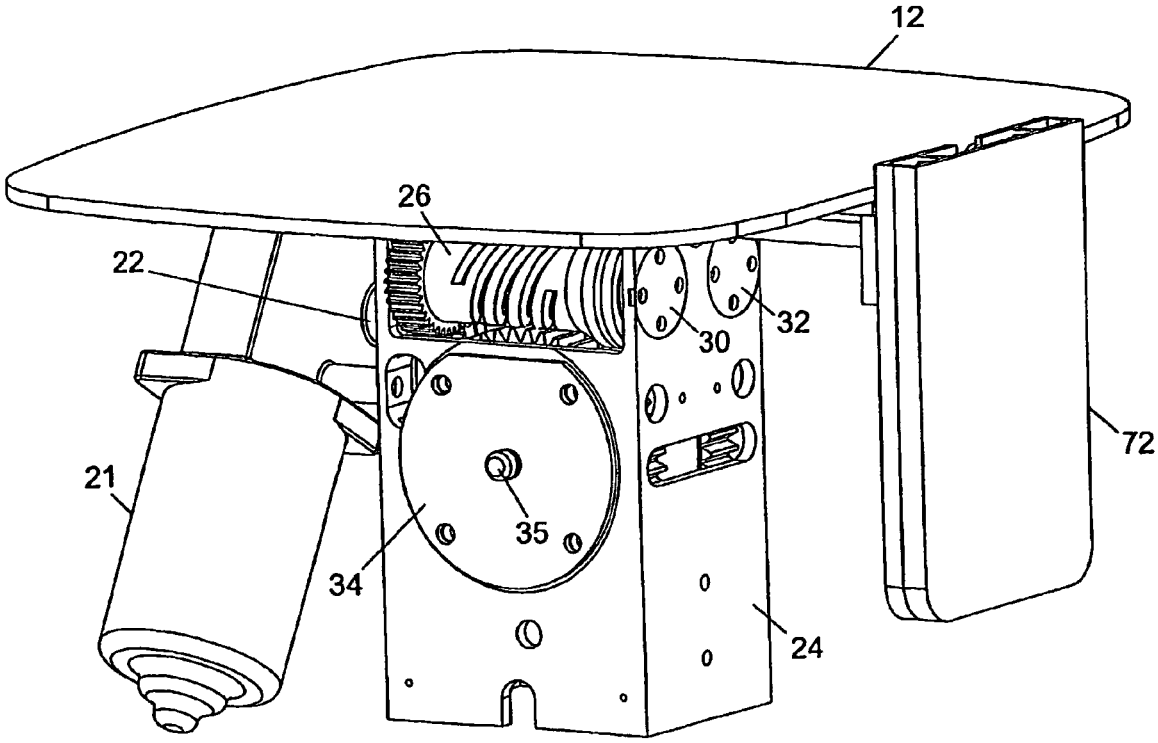
FIG. 2*a* is a close-up view of the main elements of the present invention.

FIG. 2*a* shows the main elements of the present invention suspended from the plate 12. The main elements include an electric motor 21, which is mounted under the plate 12 to a drive train support box 24 by screw fasteners or the like. The motor may be a 12 VDC Valeo right angle gear drive motor, or any other drive motor that can supply the desired torque and speed. The motor 21 includes an output or drive shaft 22, which extends towards the drive train support box 24. The drive train support box 24 is also attached to the support plate 12 and includes various elements of the drive train. A pair of parallel worm gears of which one is shown at 26 are driven by the drive shaft 22 through appropriate gears as explained below. The worm gears are rotatably supported by support fittings 30, 32, at one end as shown. Most preferably each of the worm gears are supported on a single worm shaft having at least one ball bearing. Also shown is a spool support plate 34 with spool axle 35 in the support box 24.

FIG. 2*b* shows the same elements as 2*a*, but with the support plate 12 and support box 24 removed, to reveal the second worm gear 28. As shown, the drive shaft 22 includes a drive gear 38 which simultaneously drives both worm gears 26, 28, through mating gears 40, 42, at the motor end of the worm gears 26, 28. Both of the worm gears in turn drive the spool 44 by interacting with teeth of opposed helical side spool gears shown at 46 and 47. Most preferably the worm gear/spool gear ratio is about 4:50, but other ratios may also be used and are comprehended by the present invention. As can now be appreciated the motor, when energized, will turn the drive shaft, which in turn will drive the worm gears 26, 28. Then, the worm gears turn and cause the spool 44 to turn. The strap 14 suspended from the spool 44 is either taken up or lowered depending upon the direction the motor 21 is turning.

It can now be appreciated that an additional benefit of the twin worm gears 26, 28 of the present invention is that the forces on the two worm gears are only about one half of the forces otherwise generated on a single worm gear, which means that lower strength materials can be used in the construction of the worm gears. In some cases the twin worm gear design will permit hardened plastics to be used, which reduce the weight and expense of the present invention. Otherwise machined metal parts can also be used. The present invention comprehends that the output gear of the motor interacts with the drive gears of the worm gears at a ratio of 2:1.

FIG. 2*b* also shows the elements of the emergency lower device according to the present invention. In particular, there is shown a take off gear 60, attached to a manual lower shaft 62, which extends through a bearing holder assembly 64 and ends in chain gear 66. The take off gear 60 engages the gears 40, 42, and is either driven or drives the same, depending upon the circumstances, as described in more detail below. The bearing holder assembly 64 rotatably houses the manual lower shaft 62 while holding the shaft in place. The assembly 64 preferably includes pivoting chain guides 68, 70 which are sized and shaped to guide, for example, a chain 74 over chain gear 66.

A chain 74 (FIG. 4) is carried in the cover 72 and is most preferably in the form of a loop or endless section. The chain includes link elements sized and shaped to engage the teeth of chain gear 66. The cover 72 is releasably mounted on the bearing holder assembly 64. Releasing the cover 72 simply requires a sharp pull in a downward direction. Most preferably the cover 72 is sized, shaped and attached in a way that enables it to be easily dislodged with any convenient reach extender, such as a broom handle, or the like. As the cover 72 is lowered, the chain 74, otherwise stored in the cover 72, plays out and extends down. Most preferably the chain is of a length suitable for being easily reached by a person standing on the floor, even if the device 11 is mounted on the ceiling. Good results have been achieved with the chain 74 falling four feet below its raised position. Further the cover 72 most preferably includes a chain post so that the cover is permanently attached around the chain 74.

In the raised position the chain 74 is preferably supported above the chain gear 66, and so is not driven while the motor is raising or lowering patients. The balance of the chain 74 is neatly stored inside of the cover 72. The present invention comprehends all forms of manually actuable elongate elements for use in the emergency lift and lower situation, such as ropes, extended crank handles, and the like, but a chain 74 is the most preferred form. The chain can be held out of engagement with the gear when not in use, and is flexible enough to be easily stored in the cover 72 when not in use. Then, when needed the chain 74 can be dropped onto the gear 66 as the cover 72 is lowered. As the cover 72 is further lowered, the flexible chain 74 will deploy out of the cover 72 and extend below the device 11 until it is in easy reach. The positive engagement of the links of the chain 74 on the chain gear 66 sprockets is helpful in providing enough traction to the chain 74 on the gear 66 to permit enough force to be generated to raise or lower the weight on the strap 14 without slipping.

Thus, the present invention comprehends forming the cover so that when the cover is pulled down, the chain is then caused to sit on and engage with the chain gear 66. As can be now understood, with the chain hanging down and in easy reach, an attendant is provided with a means to easily lower the patient down, even if the motor has malfunctioned. As the attendant pulls on one side of the chain, the chain gear will be caused to rotate, in turn rotating the worm gears and the spool, and thus raising or lowering the strap 14 as needed. Also shown is a gear box 300, which may be used to alter the gear ratio of the shaft 62, to permit the mechanical advantage to be optimized. For example, increasing the mechanical advantage through the gear box 300 will make it easier to use the chain for lifting, but require more movement of the chain to cause movement of the patient. Reducing the mechanical advantage through the gear box 300 means that the chain requires more force to move, but causes greater relative movement of the strap and the patient. The present invention comprehends adjusting the mechanical advantage, first, by sizing the gears 60, 40, and 42 and 38, and then, if desired, through use of a gear box 300 as shown.

Figure 3:
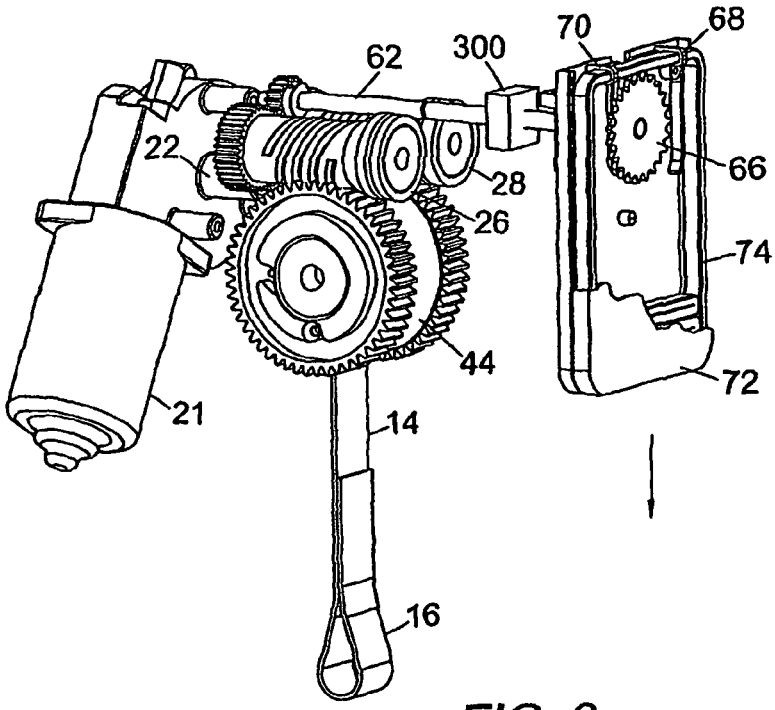
FIG. 3 shows the drive train of the present invention including a emergency lowering mechanism in a storage position.

Turning to FIG. 3, the cover 72 is shown mounted on the chain gear. The chain guides 68, 70 are in a raised position, supporting the chain 74 free of chain gear 66. It will be understood that various configurations of elements can be used, and that the preferred form of chain guides that act to guide the chain in a lower position but pivot to a raised chain supporting position provides good results.

Figure 4:
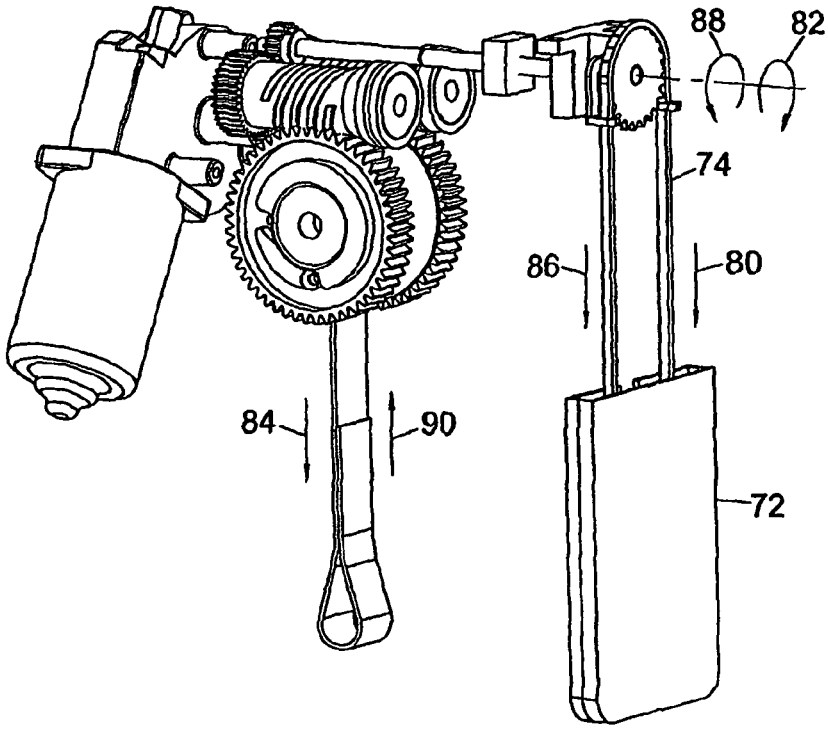
FIG. 4 is the same view as FIG. 3, showing the emergency lowering mechanism in a deployed position.

In FIG. 4 the cover is shown pulled off and exposing the chain gear 66, with the chain 74 engaging the chain gear 66. It can now be appreciated that pulling on the chain 74 in the direction of arrow 80 causes the chain gear to rotate in direction of arrow 82, causing the strap 14 to move in direction of arrow 84. Conversely, pulling the chain 74 in direction of arrow 86 causes a rotation in direction of arrow 88, moving the strap 14 in the direction of arrow 90. In this way an easily accessible and manually operable emergency lift or lower facility is provided to the device of the present invention.

It can now be understood that the chain gear 66 is in essence a take off means, for providing access to the drive train of the lift and lower device from outside. While a chain is one form of releasable element for remotely driving the take off means, other forms, such as releasable crank handles, are also comprehended. Such a crank handle can be stored unattached, and then lifted and attached if and when needed.

Figure 7:
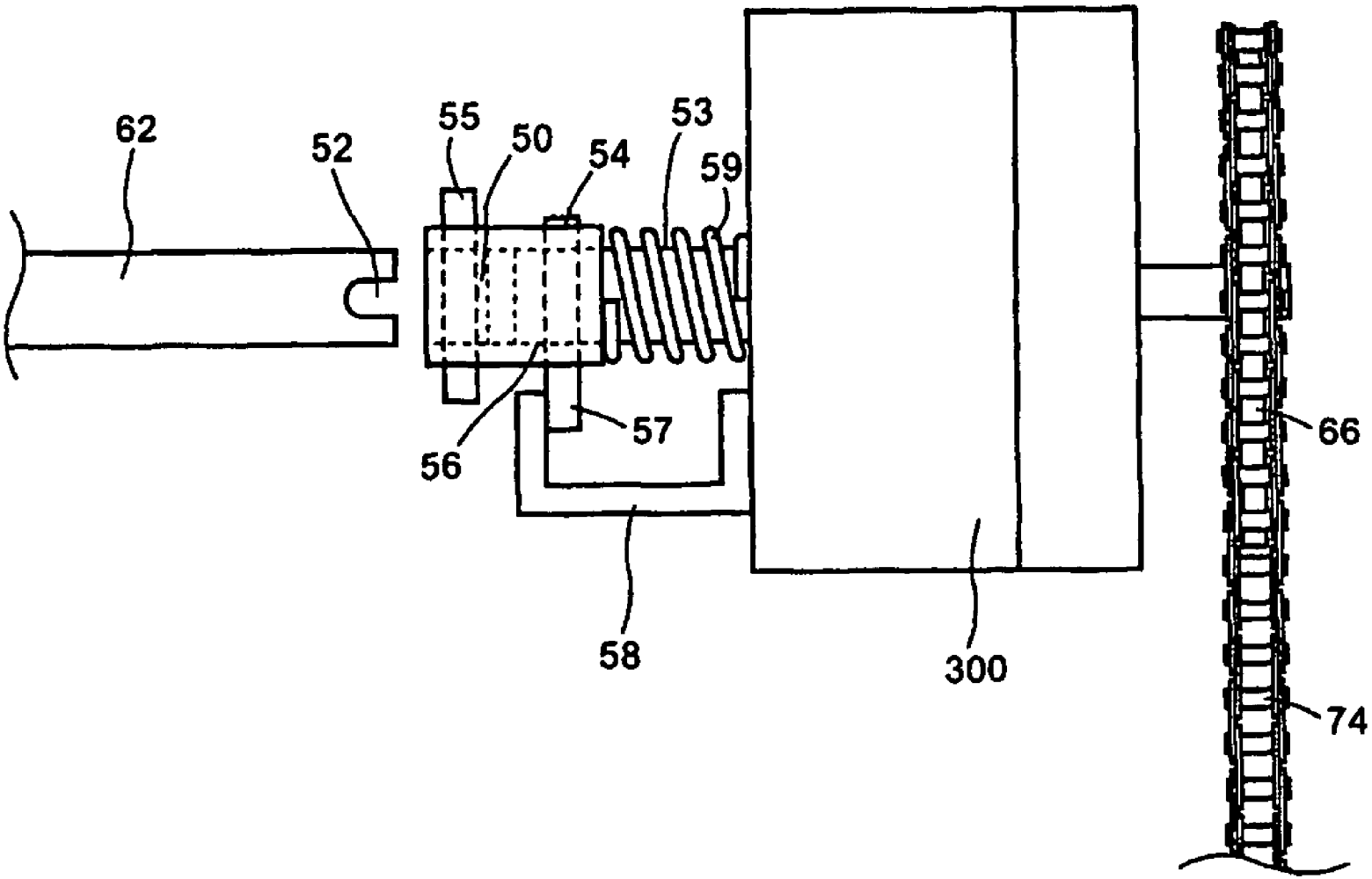
FIG. 7 is a side view of a coupler connected to the emergency lowering mechanism.

Another configuration that has provided adequate results is shown in FIG. 7. In this arrangement a coupler 50 may be inserted between the shaft 62 and the gear box 300. The coupler functions to disengage or separate the chain gear 66 from the shaft 62 during normal operation of the lift device, i.e. when the patient load is being lifted or lowered by rotation of the motor 21. When the emergency lower device is needed, the coupler 50 can be activated to connect shaft 62 to gear chain 66.

As shown in FIG. 7, shaft 62 is provided with an open-ended slot 52 at a termination point. A corresponding shaft 53 having a slot 56 projects from gear box 300. Shaft 53 ends at coupler 50, which is a generally hollow tubular element intersected by pins 54 and 55. Coupler 50 is attachable to shaft 53 through the insertion of pin 54 into slot 56, and is slidable over shaft 53. The hollow interior of coupler 50 is also sized and shaped to fit over shaft 62, and pin 55 is sized and shaped to fit inside slot 52.

Pin 54 has an external portion 57 that engages a lock 58. As shown, lock 58 may be simply a hook or stop against which external portion 57 can rest. An elastically deformable element or spring 59 fits over shaft 53 between the coupler 50 and the side of gear box 300, and provides a bias urging coupler 50 towards shaft 62. In FIG. 7 coupler 50 is shown in a retracted or locked position, with external portion 57 resting against lock 58. It can be appreciated that in this position chain gear 66 will be unaffected by the spinning of lower shaft 62.

When it is desired to employ the emergency lower device, simple rotation of chain gear 66 will cause coupler 50 and external portion 57 to rotate, freeing portion 57 from lock 58. The latent energy of spring 59 will be released, impelling coupler 50 towards shaft 62. The shafts 62 and 53 will interconnect through insertion of pin 55 into slot 52 of shaft 62. It can be appreciated that slot 56 should be sized sufficiently deep to ensure that coupler 50 does not slip off shaft 53 when pin 55 is inserted into slot 52. Alternatively, slot 56 can be made closed on both ends to ensure that slipping is prevented.

Figure 8:
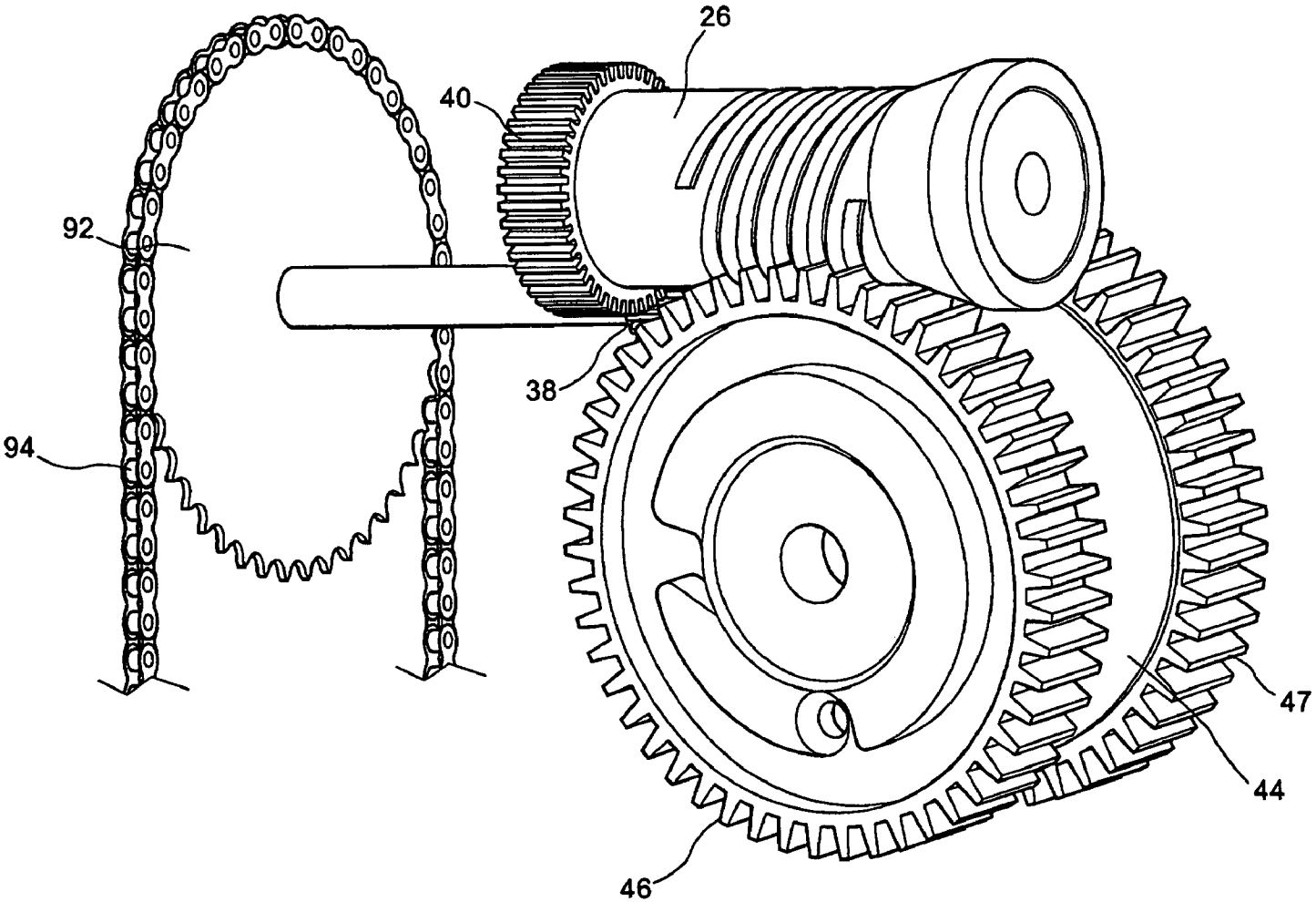
FIG. 8 is a perspective view of the drive train elements of a further embodiment of the present invention.

FIG. 8 shows an alternate embodiment of the present invention in which the device is operated manually rather than by electrical power. Motor 21 is accordingly replaced by a chain gear 92 and corresponding chain 94. In particular, chain gear 92 may be configured to rotate the same output shaft, which turns drive gear 38, as that otherwise rotated by motor 21. Since motor or electrical failure is not a concern in this embodiment, a separate emergency lower facility is not needed. This embodiment may also perform adequately with a single worm gear, as shown in FIG. 8, in cases where the expected load is suitably reduced.

It can be appreciated that pulling of the chain 94 by an attendant will raise or lower the patient in a manner similar to that described previously with respect to the emergency lower device. The chain gear 92 and chain 94 could also be enclosed by a cover similar to the cover 72 used with chain gear 66. It can be further appreciated that this embodiment could also be realized by removing the motor 21, gear box 300, and coupler 50, and relying exclusively on the emergency lift and lower device in the ordinary course.

Figure 5:
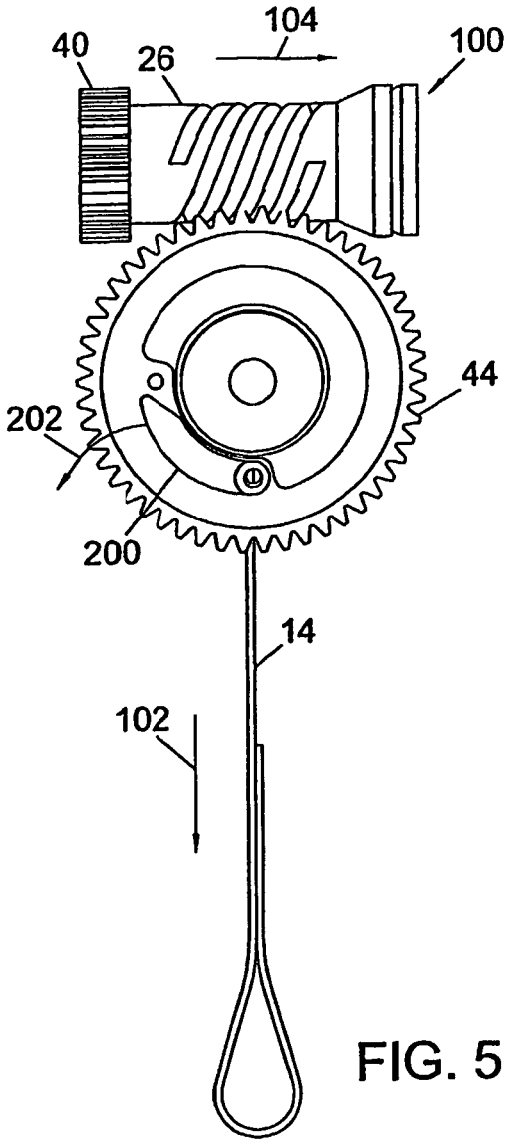
FIG. 5 is a view showing forces on a portion of the present invention when supporting a load.

In FIG. 5 certain elements of the present invention are shown in isolation for ease of understanding. In particular, the spool 44 is shown, with the lifting strap 14 extending below the spool 44. One of the worm gears 26, 28 is shown with the mating gear 40 at one end and a braking assembly 100 at the other end. The strap is wound around the spool and by means of a strap guide is fed out below the centre of the spool 44. The weight carried by the spool 44, indicated by arrow 102, creates a force 104 that drives the worm gear onto the braking assembly 100. In the preferred form of the invention, the greater the weight the greater the force on the braking assembly 100.

Figure 6:
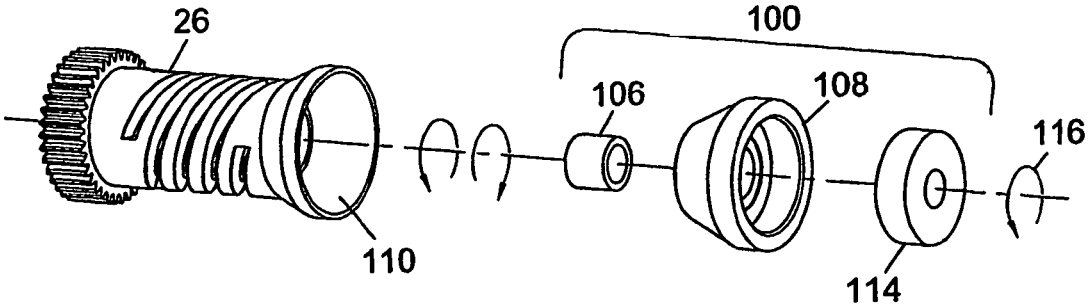
FIG. 6 is an exploded view showing the clutch and brake features of the present invention.

Turning now to FIG. 6, the elements of the braking assembly 100 are shown in exploded detail. In a preferred form a one-way clutch bearing 106 is provided upon which is mounted a cone shaped brake element 108. A conical braking or slip surface 110 is formed in the end of the worm gear 26, which is sized and shaped to match with the conical surface 112 of the cone shaped brake element 108. A ball-bearing 114 is also mounted onto the same axle as the cone shaped brake element 108.

The operation of the braking assembly 100 can now be understood. By means of the ball-bearing element the cone shaped brake element can be rotated in direction of arrow 116 together with the worm gear. Thus, when raising the strap, the worm gear and brake element rotate together, by means of the ball-bearing. However, in the lowering direction, the ball-bearing is not rotatable, meaning that for there to be any rotation the rotation must occur between the cone shaped brake surface 112 and the slip surface 110 of the worm gear 26. The cone shaped brake surface 112 will have a braking force that is a function of the seating force, namely how strongly the worm gear is pushed onto the brake surface 112. As described above the seating force is a function of the weight suspended by the strap, so the greater the suspended weight the greater the seating force and the greater the braking force. Thus, through this interacting structure a braking force can be generated which is larger for larger weights. Thus in the design range of lifting weights for the device, the braking force is self-compensating to be strong enough to support all patients, and yet for lighter patients will be less than for heavier patients.

The operation of the present invention can now be understood. When a load is to be lifted, the load is attached to the strap and lifting commences. Because the drive train of the present invention is quite efficient, most of the effort in lifting actually is directed to raising the weight, rather than to overcoming the frictional losses arising from the drive train. As noted, because the brake is mounted on a ball-bearing mechanism, none of the lifting effort is directed to overcoming the braking force, unlike prior art devices.

On the other hand, when lowering is required the motor reverses direction and the motor has to generate enough power to overcome the difference between the braking force generated by the brake and the weight. Since the weight is already in the lowering direction, only the difference between the weight and the braking force must be overcome to initiate motion. In this way, while a significant factor of safety can be built into the braking force, such that for example the braking force generated will always be between 1.5 and 2 times the weight, the motor will only have to generate enough power to overcome the difference between the two. In a similar manner, less effort will be needed to operate a manually powered device of the type shown in FIG. 8.

A further feature of the present invention can now be understood. The present invention offers a more efficient use of motor power. Even though the braking force increases with increased weight, since the weight being supported is also increased the difference remains within a reasonable range over different weights. Thus the present invention comprehends that the motor be sized and shaped as needed and of a relatively low power to cause the brake force to be overcome and for lowering to be achieved. As this low power will be somewhat constant over a range of weights being lowered, less energy is required for each lowered weight. This contrasts with the prior art, in which the inefficient gear train means that the more weight being supported, the stronger the motor must be (both in terms of maximum torque and total work). Personal lift devices are rated according to how many lift and lower cycles can be obtained from a single battery charge. By increasing the efficiency, as comprehended by this invention, either more cycles can be obtained for the same power leading to a higher rating, or smaller batteries can be used to deliver the same rating at a reduced cost.

It will now be understood that the amount of braking force is a function of a number of variables that are interrelated in a complex way. Some of these variables include the size of the in-contact overlapping brake surfaces, the angles at which the surfaces intersect, the smoothness of the surfaces, and the force exerted between the surfaces causing them to come together. By predetermined design these variables can be selected to provide a brake assembly having a preferred brake force profile to facilitate the objectives of the present invention.

Most preferably, the present invention will include a form of hand held control to start and control the motor. The control could be either hard wired, by means of a connecting cable to a control circuit in the device, pneumatic, or operable by remote control. In some cases the former is preferred to prevent the control unit from being separated and lost. The present invention comprehends the control unit having, among other things, a raise button or control. Associated with the control system is a limit switch on the motor assembly to prevent the device from being over raised, which could cause damage to the motor and other components. Thus, once the strap has been retracted a maximum amount, the motor will be simply disengaged from further motion in the raise direction by means of the limit switch.

Good results have been achieved by forming the worm gear, drive gear, and conical braking surface out of a single machined component. However, the present invention also comprehends having these elements separately mounted in the same functional relationship on an axle. The one-piece construction is preferred for safety and strength reasons. Good results have also been achieved by forming the spool from a single machined component which includes a built in strap anchor and side spool gears, all mounted on a single spool shaft. However, the present invention also comprehends forming the spool gears separately, and simply integrating them with the spool on a single spool shaft.

Additionally, for safety reasons it is preferred to include an over-speed governor into the spool. This is shown at 200 in the drawings. The preferred form of governor is simply a latch that is pivotally mounted at one end onto the spool. The mounting is such that when the spool rotates, the other end of the latch is urged outwardly. The faster the spool rotates the greater the outward urging under centrifugal acceleration. The ability of the latch to move will be restricted until a force is generated that represents uncontrolled descent of the strap. Then the latch will extend outwardly, as shown at 202, and lock the spool against any further rotation.

It will be appreciated by those skilled in the art that various modifications and alterations to the invention are possible without departing from the broad spirit of the invention as described above and in the appended claims. Some of these were discussed above and others will be apparent. For example, while use of a chain is preferred, other forms of emergency lower elements can also be used, such as crank handles.

The embodiment of the invention in which an exclusive property or privilege is claimed are defined as follows:

1. A personal lift device comprising: a motor having an output shaft; a gearing system operatively connected to said output shaft for increasing torque; a strap for suspending a weight a spool for suspending said strap and for extending and retracting said strap; a drive connection between said gearing system and said spool to permit said motor to drive said spool; and a brake, associated with said spool to prevent unwanted extension of said strap from said spool, when a force is applied to said strap; wherein the brake creates a braking force through frictional contact between two surfaces; wherein the gearing system is efficient enough to permit the spool to back drive, in the absence of the brake; wherein said spool transmits at least some of said force applied to said strap onto said frictional contact surfaces; wherein a braking force generated by said frictional contact is proportional to said force applied to said strap; and wherein said motor, through said gearing system, generates enough force to overcome said braking force to extend said strap.

2. The personal lift device of claim 1 wherein said frictional contact surfaces are sized and shared to permit said brake to prevent unwanted extension of said strap without preventing said motor from being able to extend said strap against said braking force.

3. The personal lift device of claim 2 wherein said force is applied by a weight suspended by said strap and said brake includes a ball-bearing to permit said motor to raise said weight without needing to overcome said braking force.

4. The personal lift device of claim 1 wherein said frictional contact surfaces are in the form of conical contact surfaces.

5. The personal lift device of claim 1 further including a manual lift drive located between the spool and the motor to permit the spool to be manually turned to raise or lower the strap.

6. The personal lift device of claim 5 further including a manual takeoff point for manually turning said spool for emergency lifting and lowering.

7. The personal lift device of claim 5 further including an elongated manually actuatable element which can be extended from said manual take off point for emergency lifting or lowering.

8. The personal lift device of claim 1 wherein said drive connection between said gearing system and said spool is a distributed gear system with at least two drive elements working in parallel.

9. The personal lift device of claim 8 wherein said drive elements are worm gears.

10. The personal lift device of claim 9 wherein said spool includes gear teeth which interact with said worm gear drive elements to cause said spool to rotate as said worm gears rotate.

11. The personal lift device of claim 9 wherein said worm gears are molded from plastic composite materials.

12. The personal lift device of claim 1 wherein said gearing includes a single output gear from said motor to drive parallel worm gears.

13. The personal lift device of claim 7 further including a removable cover for storing said elongate element in a raised position.

14. The personal lift device of claim 12 or 13 wherein said gearing system is at least 50 percent efficient.

15. The personal lift device of claim 12 or 13 wherein said gearing system is at least 80 percent efficient.

16. The personal lift device of claim 1 further including a source of electrical power to drive said motor.

17. The personal lift device of claim 16 wherein said source of electrical power is a battery and said personal lift device is portable.

18. The personal lift device of claim 16 wherein said device is capable of lifting a weight of about 600 pounds.

19. A braking system for a personal lift device of the type where a weight is suspended by a strap and the strap may be extended or retracted from a spool, the braking system comprising: a brake, the brake including a frictional slip interface which slips when said weight is being lowered; an operative connection between said brake and said spool; a clutch to permit said spool to turn without overcoming the brake when said weight is being raised by said strap; wherein a braking farce generated at said frictional slip interface is correlated to said weight, to generate a larger braking force under greater weights.

20. A braking system for a personal lift device as claimed in claim 19 wherein said spool is edge driven and as said weight creates a torque on said spool said torque is transferred to said slip interface to prevent said unwanted extension of said strap.

21. A braking system for a personal lift device as claimed in claim 19 wherein said slip interface is sized and shaped to provide a sufficient braking force under a specific predetermined weight to prevent the unwanted descent of said weight.

* * * * *